US009431163B2

(12) United States Patent
Sekiguchi et al.

(10) Patent No.: US 9,431,163 B2
(45) Date of Patent: Aug. 30, 2016

(54) TRANSFORMER

(71) Applicant: MURATA MANUFACTURING CO., LTD., Kyoto (JP)

(72) Inventors: Sayaka Sekiguchi, Nagaokakyo (JP); Kosuke Ishida, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/149,656

(22) Filed: Jan. 7, 2014

(65) Prior Publication Data

US 2014/0225699 A1 Aug. 14, 2014

(30) Foreign Application Priority Data

Feb. 14, 2013 (JP) ..... 2013-026362

(51) Int. Cl.
*H01F 27/29* (2006.01)
*H01F 5/00* (2006.01)
(Continued)

(52) U.S. Cl.
CPC ..... *H01F 27/2804* (2013.01); *H01F 19/04* (2013.01); *H01F 2027/2809* (2013.01)

(58) Field of Classification Search
CPC .. H01F 27/29; H01F 27/292; H01F 27/2804; H01F 27/306; H01F 17/0013; H01F 17/003; H01F 17/0033; H01F 5/003; H01F 41/041
USPC ..... 336/192, 200, 198, 232, 83
See application file for complete search history.

(56) References Cited

U.S. PATENT DOCUMENTS 5,111,169 A * 5/1992 Ikeda ..... 333/181
6,097,273 A * 8/2000 Frye ..... H01F 5/003 333/25

(Continued)

FOREIGN PATENT DOCUMENTS

JP S61-97809 U 6/1986
JP H07-263230 A 10/1995

(Continued)

OTHER PUBLICATIONS

An Office Action; "Notification of Reasons for Rejection," issued by the Japanese Patent Office on Jan. 20, 2015, which corresponds to Japanese Patent Application No. 2013-026362 and is related to U.S. Appl. No. 14/149,656; with English language translation.

(Continued)

*Primary Examiner* — Elvin G Enad
*Assistant Examiner* — Kazi Hossain
(74) *Attorney, Agent, or Firm* — Studebaker & Brackett PC

(57) ABSTRACT

A transformer includes a first coil spiraling inwardly in a second direction. A second coil spirals along the first coil on the outside relative to the first coil. First and second external electrodes are provided in third and fourth directions relative to a first line passing through a gravity center of the first coil and an outer end thereof, respectively, the third direction being perpendicular to the first line, and the fourth direction being opposite thereto. First and second lead-out conductors are connected to the outer end of the first and the second coil, respectively, and electrically connected to the first and the second external electrodes, respectively. Both coils spiral along each other throughout their lengths. By spiraling in the second direction, the first coil is, at the outer end, oriented in a fourth direction.

6 Claims, 8 Drawing Sheets

(51) Int. Cl.

| | |
|---|---|
| ***H01F 27/28*** | (2006.01) |
| ***H01F 27/02*** | (2006.01) |
| ***H01F 19/04*** | (2006.01) |

(56) References Cited

U.S. PATENT DOCUMENTS

| | | | | |
|---|---|---|---|---|
| 6,838,970 | B2 * | 1/2005 | Basteres | H01F 17/0006 336/200 |
| 7,646,280 | B2 * | 1/2010 | Ito et al. | 336/200 |
| 7,663,225 | B2 * | 2/2010 | Kudo et al. | 257/700 |
| 7,911,295 | B2 * | 3/2011 | Inuzuka et al. | 333/185 |
| 8,325,003 | B2 * | 12/2012 | Wu | 336/200 |
| 2004/0130415 | A1 * | 7/2004 | Chiba et al. | 333/185 |
| 2006/0158301 | A1 * | 7/2006 | Shinkai et al. | 336/232 |
| 2008/0048816 | A1 * | 2/2008 | Matsumoto | H01F 19/04 336/200 |
| 2008/0303621 | A1 * | 12/2008 | Ito et al. | 336/200 |
| 2009/0243777 | A1 | 10/2009 | Toi et al. | |
| 2009/0295526 | A1 * | 12/2009 | Mikami et al. | 336/196 |
| 2012/0112869 | A1 * | 5/2012 | Nishikawa et al. | 336/200 |

FOREIGN PATENT DOCUMENTS

| | | | |
|---|---|---|---|
| JP | 2003-124027 | A | 4/2003 |
| JP | 2004-095860 | A | 3/2004 |
| JP | 2005-166791 | A | 6/2005 |
| JP | 2006-024772 | A | 1/2006 |
| JP | 2006-245369 | A | 9/2006 |
| JP | 2006-261585 | A | 9/2006 |
| JP | 2010-238777 | A | 10/2010 |
| JP | 2012-033976 | A | 2/2012 |
| WO | 2008/105213 | A1 | 9/2008 |
| WO | 2009/008253 | A1 | 1/2009 |

OTHER PUBLICATIONS

An Office Action; "Notification of Reasons for Rejection," issued by the Japanese Patent Office on Nov. 17, 2015, which corresponds to Japanese Patent Application No. 2013-026362 and is related to U.S. Appl. No. 14/149,656; with English language translation.

* cited by examiner

TRANSFORMER

CROSS REFERENCE TO RELATED APPLICATIONS

This application claims benefit of priority to Japanese Patent Application No. 2013-026362 filed on Feb. 14, 2013, the entire content of which is incorporated herein by reference.

TECHNICAL FIELD

The present technical field relates to transformers, more particularly to a transformer including two coils.

BACKGROUND

As an disclosure related to a conventional transformer, a common-mode noise filter described in, for example, Japanese Patent Laid-Open Publication No. 2006-24772 is known. FIG. 10 is a configuration diagram of the common-mode noise filter 500 described in Japanese Patent Laid-Open Publication No. 2006-24772.

The common-mode noise filter 500 includes a first coil 510, a second coil 520, lead-out portions 511, 512, 521, and 522, and external electrodes 513, 514, 523, and 524. The first coil 510 and the second coil 520 have the same spiral shape. The second coil 520, when viewed in a plan view, is positioned so as to deviate slightly from the first coil 510.

The external electrode 513 is provided on the left side surface. The external electrode 523 is provided below the external electrode 513 on the left side surface. The external electrode 514 is provided on the right side surface. The external electrode 524 is provided below the external electrode 514 on the right side surface. The lead-out portion 511 connects the first coil 510 and the external electrode 513. The lead-out portion 512 connects the first coil 510 and the external electrode 514. The lead-out portion 521 connects the second coil 520 and the external electrode 523. The lead-out portion 522 connects the second coil 520 and the external electrode 524.

In the common-mode noise filter 500, the first coil 510 and the second coil 520 have the same shape, and therefore have the same length. As a result, the first coil 510 and the second coil 520 can be approximated in terms of their inductance values.

However, the common-mode noise filter 500 has an issue in that it is liable to cause a difference between the first coil 510 and the second coil 520 in an inductance value. More specifically, the lead-out portion 511 is led out toward the upper left. Accordingly, a current it flowing through the lead-out portion 511 is directed in the opposite direction to a current i2 flowing near the lead-out portion 511 within the first coil 510. As a result, the magnetic field that is generated near the lead-out portion 511 within the first coil 510 is directed in the opposite direction to the magnetic field that is generated by the lead-out portion 511. Therefore, the inductance value of the first coil 510 decreases.

On the other hand, the lead-out portion 521 is led out toward the lower left. Accordingly, a current i3 flowing through the lead-out portion 521 is directed in the same direction as a current i4 flowing near the lead-out portion 521 within the second coil 520. As a result, the magnetic field that is generated near the lead-out portion 521 within the second coil 520 is directed in the same direction as the magnetic field that is generated by the lead-out portion 521. Therefore, the inductance value of the second coil 520 increases. Thus, the common-mode noise filter 500 is liable to cause a difference between the first coil 510 and the second coil 520 in an inductance value.

SUMMARY

Therefore, an object of the present disclosure provides a transformer capable of making inductance values of two coils thereof approximated.

A transformer according to an embodiment of the present disclosure includes: a body; a first coil conductor that is provided in the body, and, when viewed in a plan view in a first predetermined direction, spirals inwardly in a second predetermined direction; a second coil conductor that is provided in the body, and, when viewed in a plan view in the first predetermined direction, spirals along the first coil conductor on the outside relative to the first coil conductor; a first external electrode that, when viewed in a plan view in the first predetermined direction, is provided on a surface of the body in a third predetermined direction relative to a first line passing through a gravity center of the first coil conductor and an outer end of the first coil conductor, the third predetermined direction being perpendicular to the first line; a first lead-out conductor that is connected to the outer end of the first coil conductor and is electrically connected to the first external electrode; a second external electrode that, when viewed in a plan view in the first predetermined direction, is provided on a surface of the body in a fourth predetermined direction relative to the first line, the fourth predetermined direction being opposite to the third predetermined direction; and a second lead-out conductor that is connected to the outer end of the second coil conductor and is electrically connected to the second external electrode, wherein the first coil conductor and the second coil conductor spiral along each other throughout their lengths, and by spiraling in the second predetermined direction, the first coil conductor is, at the outer end, oriented toward a fourth predetermined direction.

DETAILED DESCRIPTION

Hereinafter, a transformer according to an embodiment of the present disclosure will be described with reference to the drawings.

Configuration of Transformer

Figure 1:
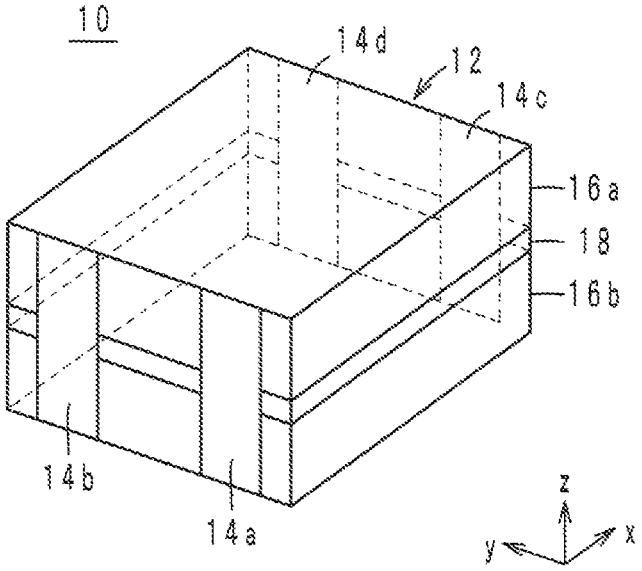
FIG. 1 is an external perspective view of a transformer.
Figure 2:
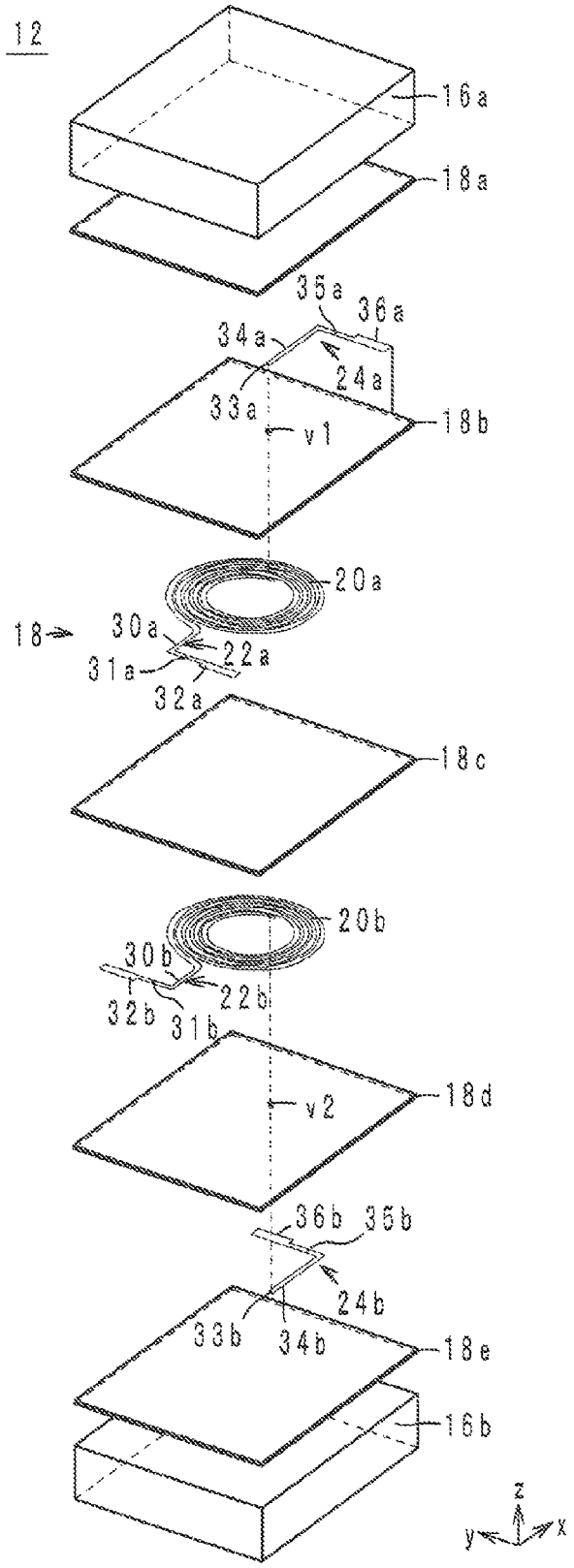
FIG. 2 is an exploded perspective view of a laminate of the transformer.
Figure 3:
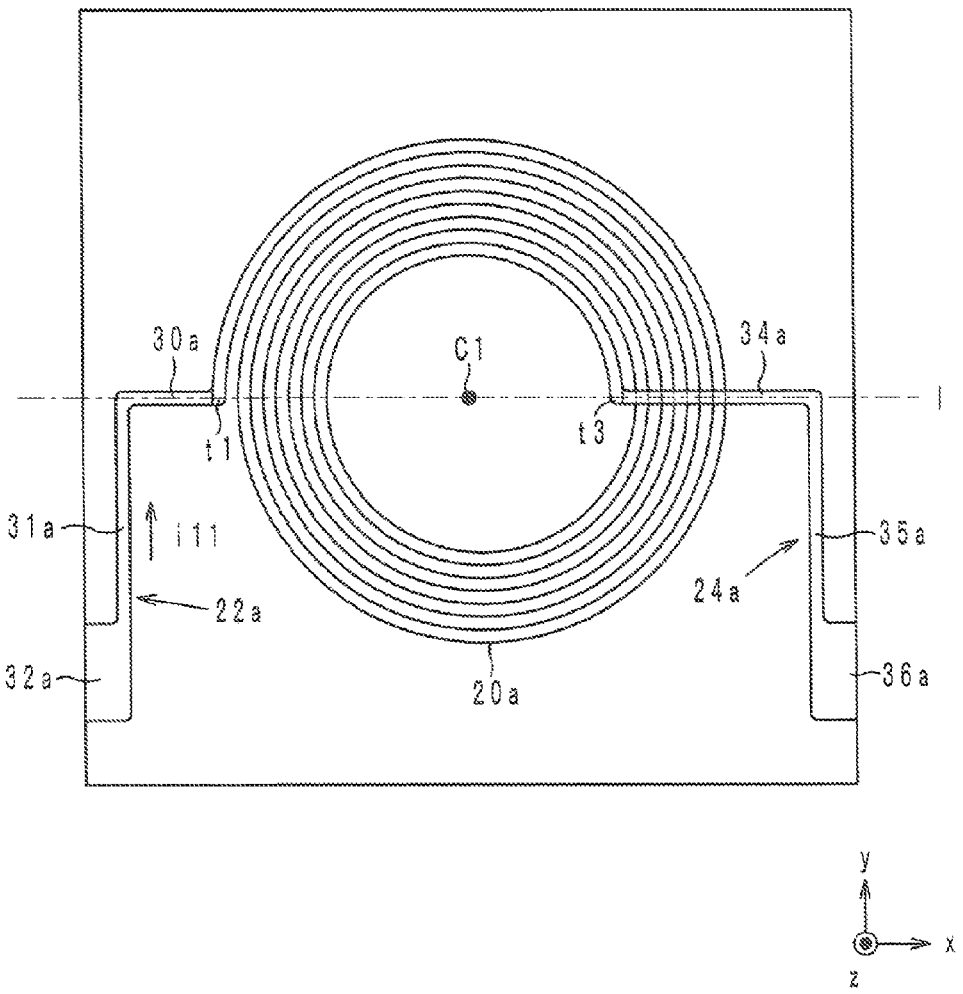
FIG. 3 is a plan view of one coil conductor and one set of lead-out conductors of the transformer.
Figure 4:
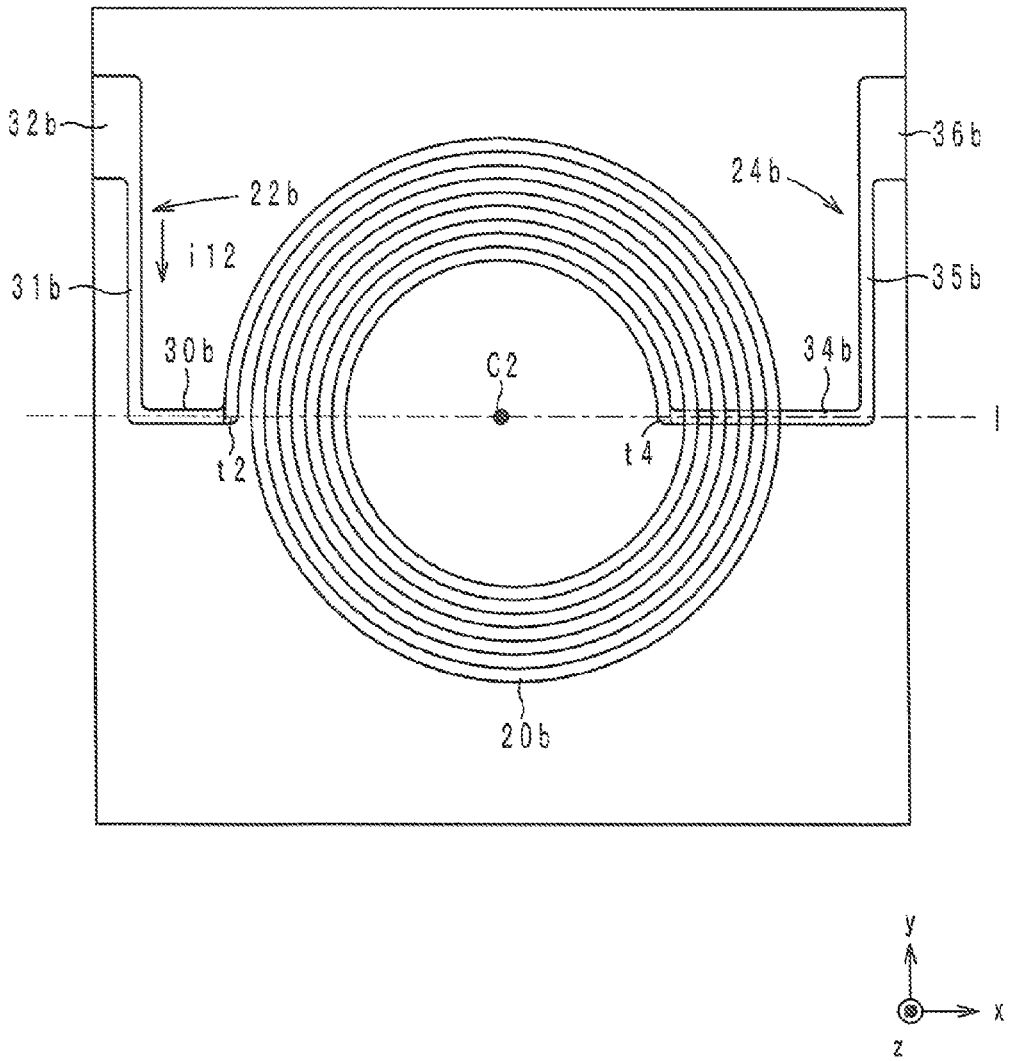
FIG. 4 is a plan view of the other coil conductor and the other set of lead-out conductors of the transformer.
Figure 5:
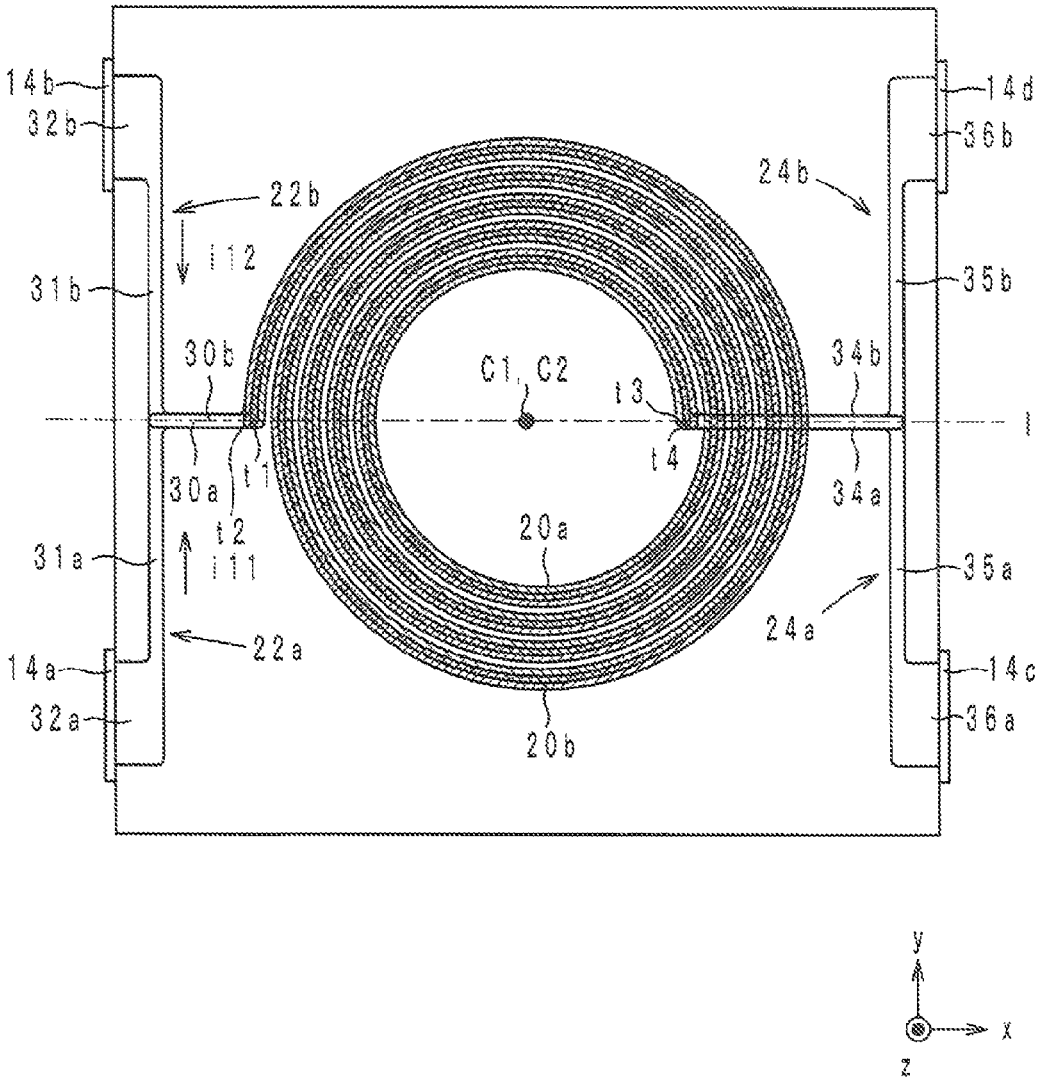
FIG. 5 is an overlapping view of the both coil conductors and the both set of lead-out conductors.

First, the configuration of the transformer will be described with reference to the drawings. FIG. 1 is an external perspective view of the transformer 10. FIG. 2 is an exploded perspective view of a laminate 12 of the transformer 10. FIG. 3 is a plan view of one coil conductor 20*a* and one set of lead-out conductors 22*a* and 24*a* of the transformer 10. FIG. 4 is a plan view of the other coil conductor 20*b* and the other set of lead-out conductors 22*b* and 24*b* of the transformer 10. FIG. 5 is an overlapping view of both coil conductors 20*a* and 20*b* and both sets of the lead-out conductors 22*a*, 22*b* and the lead-out conductors 24*a*, and 24*b*. In the following, the direction of lamination of the laminate 12 will be defined as a z-axis direction. Moreover, when viewed in a plan view in the z-axis direction, the directions in which two sides of the laminate 12 extend will be defined as x- and y-axis directions. The x-, y-, and z-axis directions are perpendicular to one another.

The transformer 10 includes the laminate 12, external electrodes 14*a* to 14*d*, the coil conductors 20*a* and 20*b*, the lead-out conductors 22*a*, 22*b*, 24*a*, and 24*b*, and via-hole conductors v1 and v2, as shown in FIGS. 1 and 2.

The laminate 12 is in the shape of a substantially rectangular solid, and includes magnetic portions 16*a* and 16*b* and a non-magnetic portion 18, as shown in FIGS. 1 and 2. The magnetic portions 16*a* and 16*b* are made of a magnetic material, such as ferrite, and are in the shape of substantially rectangular solids. Moreover, the non-magnetic portion 18 is formed by laminating non-magnetic layers (i.e., insulator layers) 18*a* to 18*e* in this order, from the positive side in the z-axis direction. The non-magnetic layers 18*a* to 18*e* are substantially rectangular, and are made of a non-magnetic material including borosilicate glass and ceramic filler. In the following, the surfaces of the non-magnetic layers 18*a* to 18*e* on the positive side in the z-axis direction will be referred to as the front faces, and the surfaces of the non-magnetic layers 18*a* to 18*e* on the negative side in the z-axis direction will be referred to as the back faces.

The coil conductors 20*a* and 20*b* are provided in the laminate 12, and electromagnetically coupled to each other. More specifically, the coil conductor 20*a* is a linear conductor provided on the front face of the non-magnetic layer 18*c*, and when viewed in a plan view in the z-axis direction, it has a spiral shape winding clockwise inwardly, as shown in FIGS. 2 and 3. The coil conductor 20*b* is a linear conductor provided on the front face of the non-magnetic layer 18*d*, which is located on the negative side in the z-axis direction relative to the non-magnetic layer 18*c* with the coil conductor 20*a* provided thereon, as shown in FIGS. 2 and 4, and when viewed in a plan view in the z-axis direction, the coil conductor 20*b* has a spiral shape winding clockwise inwardly. Moreover, the coil conductor 20*b*, when viewed in a plan view in the z-axis direction, spirals along the coil conductor 20*a* on the outside relative to the coil conductor 20*a*, as shown in FIGS. 2 and 5. In the present embodiment, the coil conductor 20*a* and the coil conductor 20*b* overlap in part with each other in the width direction thereof. Moreover, the coil conductor 20*a* and the coil conductor 20*b* spirally wind along each other throughout their lengths. Accordingly, the outer end t1 of the coil conductor 20*a* and the outer end t2 of the coil conductor 20*b* are adjacent to each other, and the inner end t3 of the coil conductor 20*a* and the inner end t4 of the coil conductor 20*b* are adjacent to each other. Moreover, the coil conductor 20*b* is longer than the coil conductor 20*a*.

Furthermore, the ends t1 and t3 and the gravity center C1 of the coil conductor 20*a* are aligned in the x-axis direction. The gravity center C1 refers to the gravity center of the coil conductor 20*a* as viewed in a plan view in the z-axis direction. In the present embodiment, the gravity center C1 substantially coincides with the center of the coil conductor 20*a*. The end t1 is positioned on the negative side in the x-axis direction relative to the gravity center C1. Accordingly, by spiraling clockwise, the coil conductor 20*a* has a directional component toward the positive side in the y-axis direction at the outer end t1. That is, the coil conductor 20*a* starts spiraling by extending from the outer end t1 toward the positive side in the y-axis direction. The end t3 is positioned on the positive side in the x-axis direction relative to the gravity center C1.

[Furthermore, the ends t2 and t4 and the gravity center C2 of the coil conductor 20*b* are aligned in the x-axis direction. The gravity center C2 refers to the gravity center of the coil conductor 20*b* as viewed in a plan view in the z-axis direction. In the present embodiment, the gravity center C2 substantially coincides with the center of the coil conductor 20*b*. The end t2 is positioned on the negative side in the x-axis direction relative to the gravity center C2. Accordingly, by spiraling clockwise, the coil conductor 20*b* has a directional component toward the positive side in the y-axis direction at the outer end t2. That is, the coil conductor 20*b* starts spiraling by extending from the outer end t2 toward the positive side in the y-axis direction. The end t4 is positioned on the positive side in the x-axis direction relative to the gravity center C2.

Note that in the present embodiment, the gravity center C1 and the gravity center C2 substantially coincide with each other when viewed in a plan view in the z-axis direction. Accordingly, the ends t1 to t4 and the gravity centers C1 and C2 are aligned in the x-axis direction. In the following, a line that passes through the ends t1 to t4 and the gravity centers C1 and C2 will be referred to as "line 1". Line 1 extends in the x-axis direction.

The external electrodes 14*a* and 14*b* are provided in the form of rectangles extending in the z-axis direction on the side surface of the laminate 12 that is located on the negative side in the x-axis direction, as shown in FIG. 1. The external electrode 14*a*, when viewed in a plan view in the z-axis direction, is positioned on the negative side in the y-axis direction relative to line 1, as shown in FIG. 5. The external electrode 14*b*, when viewed in a plan view in the z-axis direction, is positioned on the positive side in the y-axis direction relative to line 1, as shown in FIG. 5. The external electrode 14*a* and the external electrode 14*b* have a line-symmetrical relationship with respect to line 1.

The external electrodes 14*c* and 14*d* are provided in the form of rectangles extending in the z-axis direction on the side surface of the laminate 12 that is located on the positive side in the x-axis direction, as shown in FIG. 1. The external electrode 14*c*, when viewed in a plan view in the z-axis direction, is positioned on the negative side in the y-axis direction relative to line 1, as shown in FIG. 5. The external electrode 14*d*, when viewed in a plan view in the z-axis direction, is positioned on the positive side in the y-axis direction relative to line 1, as shown in FIG. 5. The external electrode 14*c* and the external electrode 14*d* have a line-symmetrical relationship with respect to line 1.

The lead-out conductor 22*a* is connected to the outer end t1 of the coil conductor 20*a*, and is electrically connected to the external electrode 14*a*, as shown in FIGS. 2, 3, and 5. More specifically, the lead-out conductor 22*a* includes lead-out portions 30*a* and 31*a*, and a connection 32*a*. The lead-out portion 30*a* extends on the front face of the non-magnetic layer 18*c* from the outer end t1 of the coil conductor 20*a* toward the negative side in the x-axis direction. However, the lead-out portion 30*a* is not led out to the side surface of the laminate 12 that is located on the negative side in the x-axis direction. The lead-out portion 31*a* extends from the end of the lead-out portion 30*a* that is located on the negative side in the x-axis direction toward the negative side in the y-axis direction. Accordingly, the lead-out portions 30*a* and 31*a* form an L-like shape. The connection 32*a*, which is located on the front face of the non-magnetic layer 18*c*, is connected to the end of the lead-out portion 31*a* that is located on the negative side in the y-axis direction, and the connection 32*a* is led out to the side of the non-magnetic layer 18*c* that is located on the negative side in the x-axis direction. Accordingly, the connection 32*a* is exposed in the form of a line extending in the y-axis direction, at the side surface of the laminate 12 that is located on the negative side in the x-axis direction. As a result, the connection 32*a* is connected to the external electrode 14*a*.

The lead-out conductor 22*b* is connected to the outer end t2 of the coil conductor 20*b*, and is electrically connected to the external electrode 14*b*, as shown in FIGS. 2, 4, and 5. More specifically, the lead-out conductor 22*b* includes lead-out portions 30*b* and 31*b* and a connection 32*b*. The lead-out portion 30*b* extends on the front face of the non-magnetic layer 18*d* from the outer end t2 of the coil conductor 20*b* toward the negative side in the x-axis direction. However, the lead-out portion 30*b* is not led out to the side surface of the laminate 12 that is located on the negative side in the x-axis direction. The lead-out portion 31*b* extends from the end of the lead-out portion 30*b* that is located on the negative side in the x-axis direction toward the positive side in the y-axis direction. Accordingly, the lead-out portions 30*b* and 31*b* form an L-like shape. The connection 32*b*, which is located on the front face of the non-magnetic layer 18*d*, is connected to the end of the lead-out portion 31*b* that is located on the positive side in the y-axis direction, and the connection 32*b* is led out to the side of the non-magnetic layer 18*d* that is located on the negative side in the x-axis direction. Accordingly, the connection 32*b* is exposed in the form of a line extending in the y-axis direction, at the side surface of the laminate 12 that is located on the negative side in the x-axis direction. As a result, the connection 32*b* is connected to the external electrode 14*b*.

Here, the lead-out conductor 22*a* and the lead-out conductor 22*b* are in a symmetrical relationship with respect to line 1. Accordingly, the lead-out portion 30*a* and the lead-out portion 30*b* have approximately the same length. Moreover, the lead-out portion 31*a* and the lead-out portion 31*b* have approximately the same length.

The lead-out conductor 24*a* is connected to the inner end t3 of the coil conductor 20*a*, and is electrically connected to the external electrode 14*c*, as shown in FIGS. 2, 3, and 5. More specifically, the lead-out conductor 24*a* includes lead-out portions 34*a* and 35*a* and a connection 36*a*. The lead-out portion 34*a* extends on the front face of the non-magnetic layer 18*b* from the inner end t3 of the coil conductor 20*a* toward the positive side in the x-axis direction. However, the lead-out portion 34*a* is not led out to the side surface of the laminate 12 that is located on the positive side in the x-axis direction. The lead-out portion 35*a* extends from the end of the lead-out portion 34*a* that is located on the positive side in the x-axis direction toward the negative side in the y-axis direction. Accordingly, the lead-out portions 34*a* and 35*a* form an L-like shape. The connection 36*a*, which is located on the front face of the non-magnetic layer 18*b*, is connected to the end of the lead-out portion 35*a* that is located on the negative side in the y-axis direction, and the connection 36*a* is led out to the side of the non-magnetic layer 18*b* that is located on the positive side in the x-axis direction. Accordingly, the connection 36*a* is exposed in the form of a line extending in the y-axis direction, at the side surface of the laminate 12 that is located on the positive side in the x-axis direction. As a result, the connection 36*a* is connected to the external electrode 14*c*.

The lead-out conductor 24*b* is connected to the inner end t4 of the coil conductor 20*b*, and is electrically connected to the external electrode 14*d*, as shown in FIGS. 2, 4, and 5. More specifically, the lead-out conductor 24*b* includes lead-out portions 34*b* and 35*b* and a connection 36*b*. The lead-out portion 34*b* extends on the front face of the non-magnetic layer 18*e* from the inner end t4 of the coil conductor 20*b* toward the positive side in the x-axis direction. However, the lead-out portion 34*b* is not led out to the side surface of the laminate 12 that is located on the positive side in the x-axis direction. The lead-out portion 35*b* extends from the end of the lead-out portion 34*b* that is located on the positive side in the x-axis direction toward the positive side in the y-axis direction. Accordingly, the lead-out portions 34*b* and 35*b* form an L-like shape. The connection 36*b*, which is located on the front face of the non-magnetic layer 18*e*, is connected to the end of the lead-out portion 35*b* that is on the positive side in the y-axis direction, and the connection 36*b* is led out to the side of the non-magnetic layer 18*e* that is located on the positive side in the x-axis direction. Accordingly, the connection 36*b* is exposed in the form of a line extending in the y-axis direction, at the side surface of the laminate 12 that is located on the positive side in the x-axis direction. As a result, the connection 36*b* is connected to the external electrode 14*d*.

Here, the lead-out conductor 24*a* and the lead-out conductor 24*b* are in a symmetrical relationship with respect to line 1. Accordingly, the lead-out portion 34*a* and the lead-out portion 34*b* have approximately the same length. Moreover, the lead-out portion 35*a* and the lead-out portion 35*b* have approximately the same length.

The via-hole conductor v1 pierces through the non-magnetic layer 18*b* in the z-axis direction, so as to connect the inner end t3 of the coil conductor 20*a* and the end of the lead-out portion 34*a* that is located on the negative side in the x-axis direction. The via-hole conductor v2 pierces through the non-magnetic layer 18*d* in the z-axis direction, so as to connect the inner end t4 of the coil conductor 20*b* and the end of the lead-out portion 34*b* that is located on the negative side in the x-axis direction.

In the transformer 10 thus configured, a magnetic flux generated by the coil conductor 20*a* passes through the coil conductor 20*b*, and a magnetic flux generated by the coil conductor 20*b* passes through the coil conductor 20*a*. Accordingly, the coil conductor 20*a* and the coil conductor 20*b* are magnetically coupled, so that the coil conductor 20*a* and the coil conductor 20*b* constitute a common-mode choke coil. In addition, the external electrodes 14*a* and 14*b* are used as input terminals, and the external electrodes 14*c* and 14*d* are used as output terminals. Specifically, differential transmission signals are inputted into the external electrodes 14*a* and 14*b*, and outputted from the external electrodes 14*c* and 14*d*. Moreover, when the differential transmission signals contain common-mode noise, the coil conductors 20*a* and 20*b* generate magnetic fluxes in the same direction because of the common-mode noise. As a result, the magnetic fluxes intensify each other, thereby generating impedance to the common-mode noise. Thus, the common-mode noise is transformed into heat, and therefore is prevented from passing through the coil conductors 20*a* and 20*b*.

Effects

The transformer 10 according to the present embodiment allows the inductance value of the coil conductor 20*a* and the inductance value of the coil conductor 20*b* to become approximate to each other. More specifically, the external electrode 14*a*, when viewed in a plan view in the z-axis direction, is provided on the negative side in the y-axis direction relative to line 1. Accordingly, the lead-out conductor 22*a* extends toward the negative side in the y-axis direction. Therefore, when a current flows clockwise through the coil conductor 20*a*, a current i11 flows through the lead-out portion 31*a* toward the positive side in the y-axis direction. As a result, a magnetic field toward the negative side in the z-axis direction is generated on the positive side in the x-axis direction relative to the lead-out portion 31*a*. On the other hand, when such a current flowing clockwise through the coil conductor 20*a* occurs, a magnetic field toward the negative side in the z-axis direction is generated within the coil conductor 20*a*. As a result, in the coil conductor 20*a*, the magnetic field generated by the lead-out portion 31*a* and the magnetic field generated by the coil conductor 20*a* are oriented in the same direction, so that the inductance value of the coil conductor 20*a* becomes relatively high.

The external electrode 14*b*, when viewed in a plan view in the z-axis direction, is provided on the positive side in the y-axis direction relative to line 1. Accordingly, the lead-out conductor 22*b* extends toward the positive side in the y-axis direction. Therefore, when a current flows clockwise through the coil conductor 20*b*, a current i12 flows through the lead-out portion 31*b* toward the negative side in the y-axis direction. As a result, a magnetic field toward the positive side in the z-axis direction is generated on the positive side in the x-axis direction relative to the lead-out portion 31*b*. On the other hand, when such a current flowing clockwise through the coil conductor 20*b* occurs, a magnetic field toward the negative side in the z-axis direction is generated within the coil conductor 20*b*. As a result, in the coil conductor 20*b*, the magnetic field generated by the lead-out portion 31*b* and the magnetic field generated by the coil conductor 20*b* are oriented in opposite directions, so that the inductance value of the coil conductor 20*b* becomes relatively low. In this manner, the lead-out conductors 22*a* and 22*b* might cause the inductance value of the coil conductor 20*b* to be less than the inductance value of the coil conductor 20*a*.

Therefore, in the transformer 10, the coil conductor 20*b*, when viewed in a plan view in the z-axis direction, spirals along the coil conductor 20*a* on the outside relative to the coil conductor 20*a*. In addition, the coil conductor 20*a* and the coil conductor 20*b* spirally wind along each other throughout their lengths. Therefore, the coil conductor 20*b* is longer than the coil conductor 20*a*. That is, the magnetic field generated by the coil conductor 20*b* is stronger than the magnetic field generated by the coil conductor 20*a*. As a result, the inductance value of the coil conductor 20*a* and the inductance value of the coil conductor 20*b* become approximate to each other.

In the case where the transformer 10 is used as a common-mode choke coil, as the inductance value of the coil conductor 20*a* and the inductance value of the coil conductor 20*b* become approximate to each other, as described above, the difference between the phases of first and second signals that constitute a differential transmission signal approximates 180 degrees.

Furthermore, in the case where the transformer 10 is used as a common-mode choke coil, as the inductance value of the coil conductor 20*a* and the inductance value of the coil conductor 20*b* become approximate to each other, the magnetic flux that a first signal causes the coil conductor 20*a* to generate and the magnetic flux that a second signal causes the coil conductor 20*b* to generate are cancelled out efficiently when a differential-mode signal consisting of the first and second signals passes through the transformer 10. Thus, the differential-mode signal is inhibited from being converted into common-mode noise in the transformer 10.

Furthermore, in the case where the transformer 10 is used as a balun, as the inductance value of the coil conductor 20*a* and the inductance value of the coil conductor 20*b* become approximate to each other, the transformer 10 starts to output a differential signal consisting of first and second signals which are out of phase by 180 degrees. Thus, common-mode noise is inhibited from being included in output signals.

To more clearly demonstrate the effects achieved by the transformer 10, the present inventors carried out the following computer simulations. The inventors created a first model with the structure of the transformer 10, and a second model in which the coil conductor 20*a* and the coil conductor 20*b* of the transformer 10, when viewed in a plan view in the z-axis direction, coincide with each other in an entirely overlapping manner. The first model is a model according to an example, and the second model is a model according to a comparative example. Each of the first and second models was used as a common-mode choke coil, and S-parameters were computed by inputting differential transmission signals to the first and second models. The computed S-parameters were S21, S43, and Sdc21. The parameters S21 and S43 are transmission characteristics of the first and second models. Specifically, the parameter S21 is the ratio of the intensity of a first signal inputted to the external electrode 14*a* to the intensity of the first signal outputted from the external electrode 14*c*. The parameter S43 is the ratio of the intensity of a second signal inputted to the external electrode 14*b* to the intensity of the second signal outputted from the external electrode 14*d*. The parameter Sdc21 represents the rate of a differential-mode signal being converted into common-mode noise.

Figure 6:
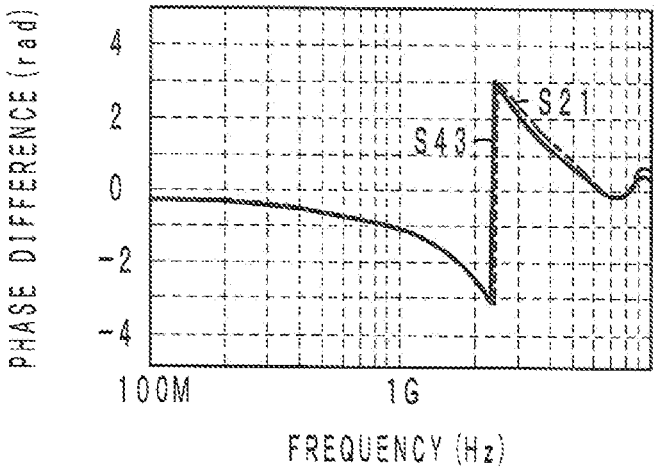
FIG. 6 is a graph showing the relationship between the frequency and the phase differences for S21 and S43 in a first model.
Figure 7:
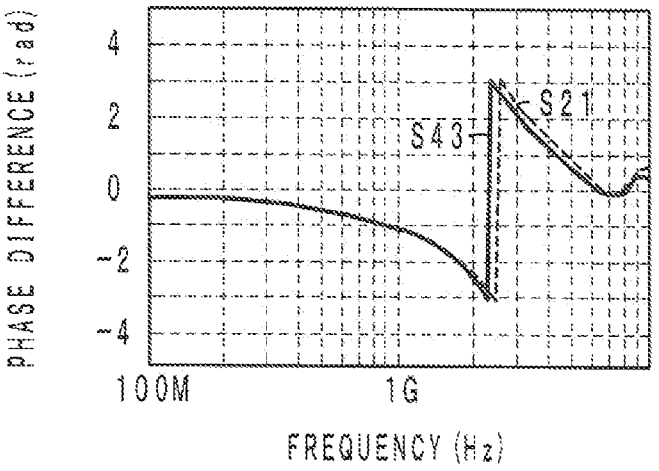
FIG. 7 is a graph showing the relationship between the frequency and the phase differences for S21 and S43 in a second model.
Figure 8:
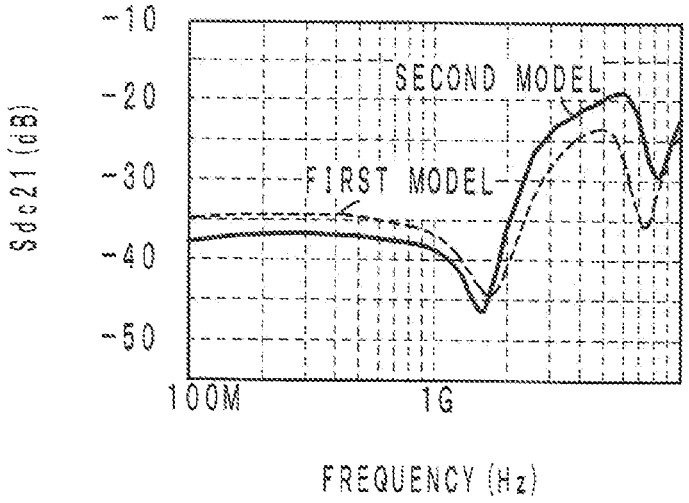
FIG. 8 is a graph showing the relationship of the frequency with Sdc21 in the first and second models.

FIG. 6 is a graph showing the relationship between the frequency and the phase differences for the parameters S21 and S43 in the first model. FIG. 7 is a graph showing the relationship between the frequency and the phase differences for the parameters S21 and S43 in the second model. FIG. 8 is a graph showing the relationship of the frequency with the parameter Sdc21 in the first and second models. In FIGS. 6 and 7, the vertical axis represents the phase difference, and the horizontal axis represents the frequency. In FIG. 8, the vertical axis represents the intensity ratio, and the horizontal axis represents the frequency.

From FIG. 7, it can be appreciated that in the second model, the frequency at which the same phase difference occurs varies between S21 and S43. Specifically, it can be appreciated that in the second model, the phase difference between the inputted first signal and the outputted first signal deviates from the phase difference between the inputted second signal and the outputted second signal. Thus, it can be appreciated that in the second model, the phase difference between the first and second signals to be outputted tends to deviate from 180 degrees.

On the other hand, from FIG. 6, it can be appreciated that in the first model, the frequency at which the same phase difference occurs is equal between S21 and S43. Specifically, it can be appreciated that in the first model, the phase difference between the inputted first signal and the outputted first signal is less subject to deviating from the phase difference between the inputted second signal and the outputted second signal. Thus, it can be appreciated that in the first model, the phase difference between the first and second signals to be outputted is less subject to deviating from 180 degrees.

Furthermore, from FIG. 8, it can be appreciated that Sdc21 is lower in the first model than in the second model. Accordingly, it can be appreciated that conversion of the differential-mode signal into common-mode noise is inhibited in the first model more than in the second model.

Figure 9:
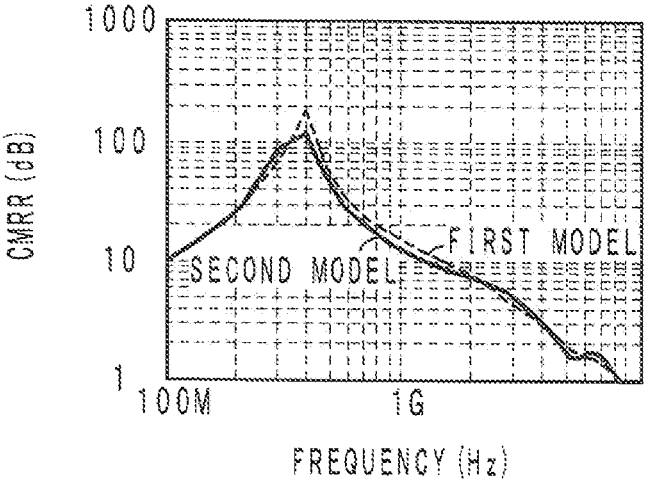
FIG. 9 is a graph showing the relationship between the frequency and the CMRR in the first and second models.
Figure 10:
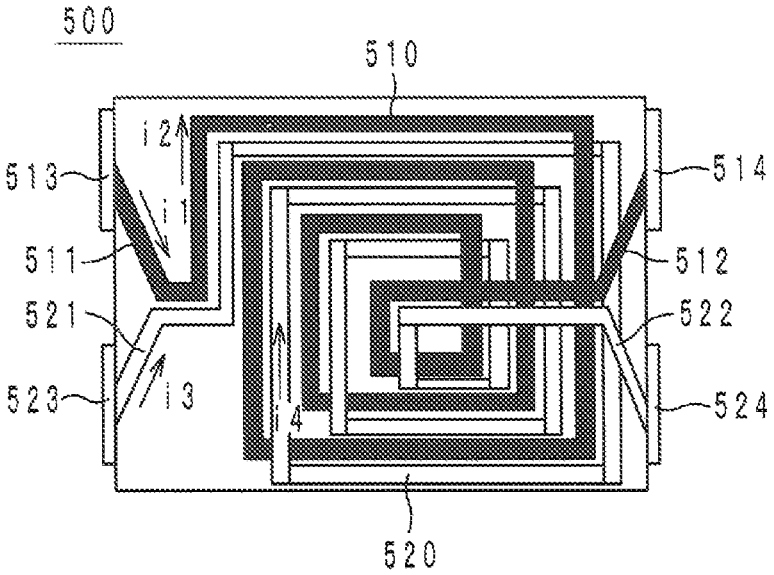
FIG. 10 PRIOR ART
FIG. 10 is a configuration diagram of a common-mode noise filter described in Japanese Patent Laid-Open Publication No. 2006-24772.

Furthermore, the present inventors carried out the following computer simulations using the first and second models. Specifically, the first and second models were used as baluns, and common-mode rejection ratios (CMRRs) were computed by inputting first signals to the first and second models. FIG. 9 is a graph showing the relationship between the frequency and the CMRR in the first and second models. In FIG. 9, the vertical axis represents the CMRR, and the horizontal axis represents the frequency.

From FIG. 9, it can be appreciated that the CMRR is higher in the first model than in the second model. Thus, it can be appreciated that the intensity of the common-mode component in an output signal is lower in the first model than in the second model.

Other Embodiments

The present disclosure is not limited to the transformer 10, and variations can be made within the spirit and scope of the disclosure.

Note that the transformer 10 may be provided with a core made of a magnetic material and piercing through the gravity center of the coil conductor 20*a* and the gravity center of the coil conductor 20*b* in the z-axis direction. This renders it possible to increase a coefficient of coupling between the coil conductor 20*a* and the coil conductor 20*b*.

Note that in the transformer 10, the coil conductor 20*a* and the coil conductor 20*b*, when viewed in a plan view in the z-axis direction, overlap in part in the width direction, as shown in FIG. 5. However, the coil conductor 20*a* and the coil conductor 20*b* do not necessarily overlap in the width direction. In such a case, when viewed in a plan view in the z-axis direction, the coil conductor 20*b* is positioned between adjacent winds of the coil conductor 20*a*, and the coil conductor 20*a* is positioned between adjacent winds of the coil conductor 20*b*. In this configuration, the coil conductor 20*a* and the coil conductor 20*b* do not overlap each other, resulting in a reduced difference in thickness in the z-axis direction between the area in which the coil conductor 20*a* is provided and the area in which the coil conductor 20*b* is provided. Thus, the laminate 12 can be inhibited from having irregularities formed therein.

Furthermore, in the case where the coil conductors 20*a* and 20*b* are to be provided so as not to overlap in the z-axis direction, the coil conductors 20*a* and 20*b* may be provided on the same insulator layer.

Furthermore, the coil conductors 20*a* and 20*b* have circular outlines, but they may have rectangular or elliptical outlines.

Note that a plate-like substrate may be used in place of the laminate 12. In such a case, the coil conductor 20*a* is provided on the principal surface of the substrate that is located on the positive side in the z-axis direction, and the coil conductor 20*b* is provided on the principal surface of the substrate that is located on the negative side in the z-axis direction.

Although the present disclosure has been described in connection with the preferred embodiment above, it is to be noted that various changes and modifications are possible to those who are skilled in the art. Such changes and modifications are to be understood as being within the scope of the disclosure.

What is claimed is:

1. A transformer comprising:

a body;

a first coil conductor provided in the body, and, when the first coil conductor is viewed in a plan view in a first predetermined direction, the first coil conductor spirals inwardly in a second predetermined direction;

a second coil conductor provided in the body, and, when the second coil conductor is viewed in a plan view in the first predetermined direction, the second coil conductor spirals along the first coil conductor on the outside relative to the first coil conductor;

a first external electrode, when viewed in a plan view in the first predetermined direction, being provided on a surface of the body in a third predetermined direction relative to a first line passing through a gravity center of the first coil conductor and an outer end of the first coil conductor, the third predetermined direction being perpendicular to the first line;

a first lead-out conductor connected to the outer end of the first coil conductor and being electrically connected to the first external electrode;

a second external electrode, when viewed in a plan view in the first predetermined direction, being provided on a surface of the body in a fourth predetermined direction relative to the first line, the fourth predetermined direction being opposite to the third predetermined direction; and a second lead-out conductor connected to an outer end of the second coil conductor and being electrically connected to the second external electrode, the first coil conductor and the second coil conductor spiraling along each other throughout their lengths, and by spiraling in the second predetermined direction, the first coil conductor is, at the outer end, oriented toward the fourth predetermined direction.

2. The transformer according to claim 1, wherein the body is a laminate formed by laminating a plurality of insulator layers.

3. The transformer according to claim 2, wherein the first coil conductor and the second coil conductor are provided on different insulator layers.

4. The transformer according to claim 1, wherein the first lead-out conductor and the second lead-out conductor are approximately in a line-symmetrical relationship with respect to the first line.

5. The transformer according to claim 1, wherein, when the first coil conductor and the second coil conductor are viewed in a plan view in the first predetermined direction, the first coil conductor and the second coil conductor overlap with each other in a widthwise direction thereof.

6. The transformer according to claim 2, further comprising:

a third lead-out conductor connected to an inner end of the first coil conductor via a via-hole conductor and provided on one of the plurality of insulator layers different from one of the plurality of insulator layers on which the first coil conductor is provided; and a fourth lead-out conductor connected to an inner end of the second coil conductor via a via-hole conductor and provided on one of the plurality of insulator layers different from one of the plurality of insulator layers on which the second coil conductor is provided.

* * * * *